US010674798B2

(12) United States Patent
Machuca

(10) Patent No.: US 10,674,798 B2
(45) Date of Patent: Jun. 9, 2020

(54) GENERAL INFANTRY ZIPPER BAG AND RELATED METHODS OF USE

(76) Inventor: Edwin Machuca, Cypress, TX (US)

( * ) Notice: Subject to any disclaimer, the term of this patent is extended or adjusted under 35 U.S.C. 154(b) by 0 days.

(21) Appl. No.: 13/543,740

(22) Filed: Jul. 6, 2012

(65) Prior Publication Data

US 2014/0008166 A1 Jan. 9, 2014

(51) Int. Cl.

| | |
|---|---|
| ***A45C 3/00*** | (2006.01) |
| ***A45C 13/20*** | (2006.01) |
| ***A45F 3/04*** | (2006.01) |

(52) U.S. Cl.

CPC ..... *A45C 3/00* (2013.01); *A45C 3/001* (2013.01); *A45C 13/20* (2013.01); *A45F 3/04* (2013.01); *A45C 2003/008* (2013.01)

(58) Field of Classification Search

CPC .. A45C 13/02; A45C 5/06; A45C 3/00; A45C 5/14; A45C 3/02

USPC ..... 190/100, 112; 150/117, 111, 103; 119/168; 206/8, 579, 494, 457, 316.1, 206/315.1, 223; 224/655, 651

See application file for complete search history.

(56) References Cited

U.S. PATENT DOCUMENTS 2,159,279 A * 5/1939 Lipowsky ..... A47G 29/14 383/22
4,175,604 A * 11/1979 Bonner ..... 383/5
4,484,362 A * 11/1984 Asher ..... A41D 3/08 2/69
5,265,719 A * 11/1993 Wand ..... 206/223
5,386,616 A * 2/1995 Norvell ..... A44B 19/32 24/384
5,458,278 A * 10/1995 LaConte ..... A45C 13/103 224/153
5,762,170 A * 6/1998 Shyr et al. ..... 190/109
6,092,266 A * 7/2000 Lee ..... 24/389
6,561,329 B2 * 5/2003 Stobbs, II ..... A45C 3/00 190/112
6,601,743 B2 * 8/2003 Godshaw ..... A45C 9/00 190/113
6,651,853 B2 * 11/2003 Higgins ..... A45F 3/04 224/155
D577,483 S * 9/2008 Tagliati ..... D3/202
8,074,853 B1 * 12/2011 Hirshberg ..... A45C 3/001 224/655
8,870,045 B1 * 10/2014 Aguirre ..... A45F 3/04 224/581
8,910,844 B2 * 12/2014 Rowe ..... A45F 3/042 224/654
9,027,813 B2 * 5/2015 Murdoch ..... A45F 3/04 224/637
9,173,462 B2 * 11/2015 Thompson ..... A45C 7/0022

* cited by examiner

*Primary Examiner* — Tri M Mai

(74) *Attorney, Agent, or Firm* — Lamon Patent Services; Cynthia S. Lamon

(57) ABSTRACT

Broadly, the bag may be a drab heavyweight Cudara double strap duffle bag with: (1) a flap-covered and water proofed zipper along the length of the bag; (2) a light fabric bottom so that ownership identity information may be readily stenciled thereon the light fabric; and (3) a chain or other lock on the top flap so that the bag may be locked or chained to a secure location.

3 Claims, 3 Drawing Sheets

GENERAL INFANTRY ZIPPER BAG AND RELATED METHODS OF USE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of Invention

The present application is in the field of luggage or baggage for general infantry in the armed forces or outdoorsmen.

Background of the Invention

Frequently, soldiers in the general infantry of the U.S. armed forces are deployed to remote locations throughout the world. Occasionally, the soldiers are required to lug personal effects to said locations. Accordingly, there is a need for luggage for soldiers in the general infantry of the U.S. armed forces.

Although luggage is necessary, in many deployment scenarios, soldiers are required to meet certain baggage rules. For instance, baggage rules for recent soldier deployees restricted luggage to two camouflage duffle bags of seventy pounds each and one carry-on bag; no suitcases, footlockers, or wheeled luggage were allowed. Restricting luggage to duffle bags can be problematic in certain instances. For example, heavy loads are hard to lug via duffle bags. What is more, deployees frequently comingle luggage and, when all luggage is camouflaged, sorting ownership of the luggage can be tedious. Yet still, a problem with current duffle bags is that the same are hard to lock whereby the soldiers' personal effects are constantly under the threat of theft. Accordingly, a need exists for luggage that eases the carrying of heavy loads, eases the identification of the luggage's owner, and that is capable of being easily locked for security.

Other problems arise in connection with duffle bags for soldiers in the general infantry. For instance, some duffle bags are water proofed, but to reduce the amount of seams in the bag whereby waterproofing because easier, such waterproofed bags are limited in terms of access to the contents of the bag. Accordingly there is a need for water proofed duffle bags with easy access to the contents thereof.

SUMMARY OF THE INVENTION

In view of the foregoing, it is an object of this application to disclose improved duffle bags for use in the general infantry of the U.S. armed forces. In one embodiment, the disclosed bag is a General Infantry (G.I.) drab heavyweight Cudara double strap duffle bag with: (1) a flap-covered and water proofed zipper along the length of the bag; (2) a light fabric bottom so that ownership identity information may be readily stenciled thereon the light fabric; and (3) a chain or other lock on the top flap so that the bag may be locked or chained to a secure location. The disclosed bag is superior to heretofore known G.I. bags because the contents of the bag are more accessible in view of the lengthwise zipper and the security of the bag is increased in view of the chain and owner identity information stenciled onto the bag.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

In general, disclosed is an improved duffle bag for use by the general infantry of the U.S. armed forces. Broadly, the bag may be a drab heavyweight Cudara double strap duffle bag with: (1) a flap-covered and water proofed zipper along the length of the bag; (2) a light fabric bottom so that ownership identity information may be readily stenciled thereon the light fabric; and (3) a chain or other lock on the top flap so that the bag may be locked or chained to a secure location. The more specific details of the bag are disclosed in connection with the figures.

FIGS. 1 through 8 are respectively a top, a bottom, a rear, a front, a left side, a right side, and environmental views of a duffle bag 1000. As depicted in the figures, the bag 1000 comprises: a body 1100 configured for retaining items; a top opening 1200 for accessing the items retained by the body 1100; a light-colored butt 1300; web straps 1400; and a waterproof side opening 1500 for accessing the items retained by the body 1100. Still referring to FIGS. 1 through 8, the bag 1000 generally defines a rectangular-box enclosure, wherein the body 1100 represents the sides of the enclosure, the butt 1300 defines the bottom of the enclosure, and the top opening defines the top side of the enclosure. In one embodiment, the size of the rectangular box may suitably be thirty six inches by twelve inches by twelve inches (36"×12"×12").

Figure 1:
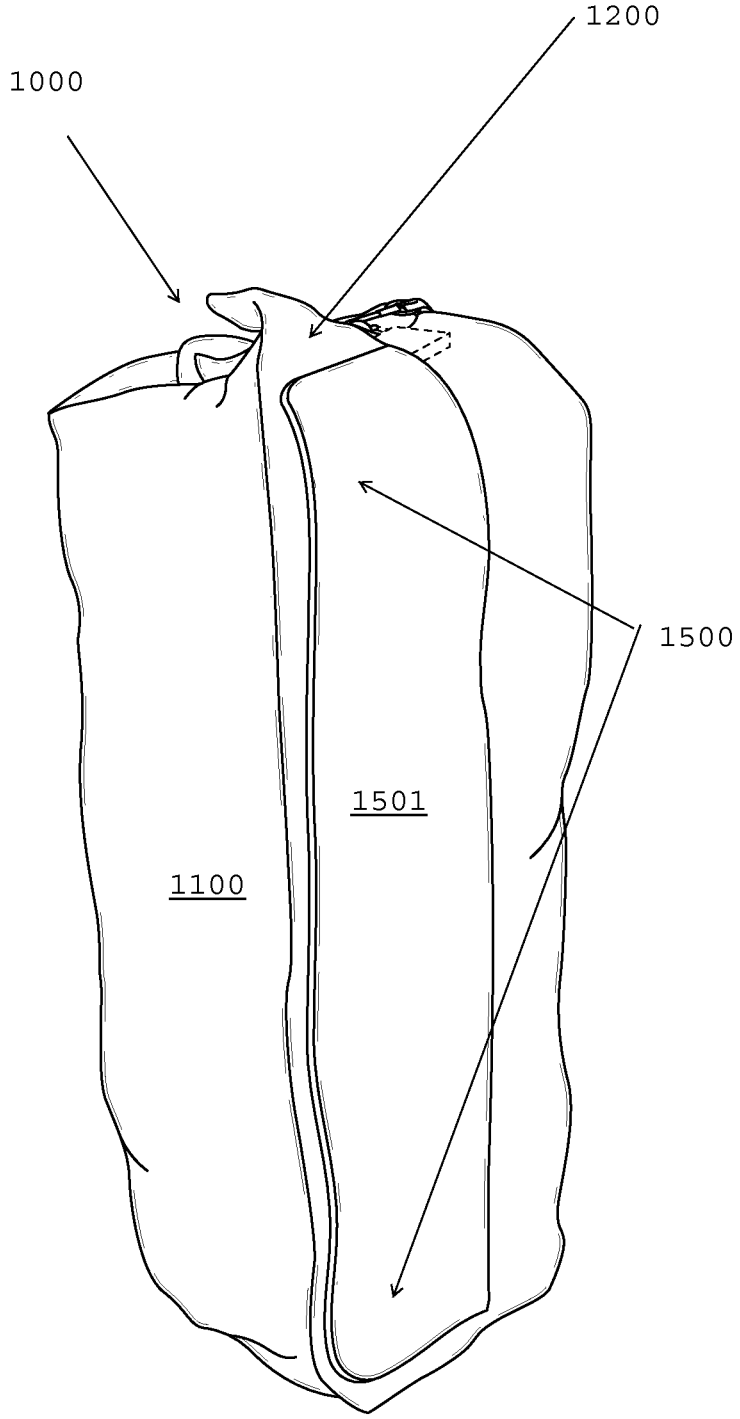
FIG. 1 is a perspective view of a duffle bag.
Figure 2:
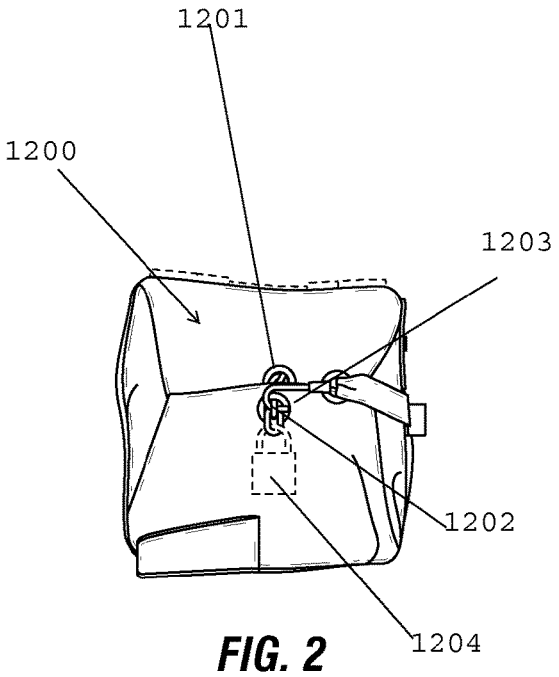
FIG. 2 is a top view of the duffle bag of FIG. 1.
Figure 3:
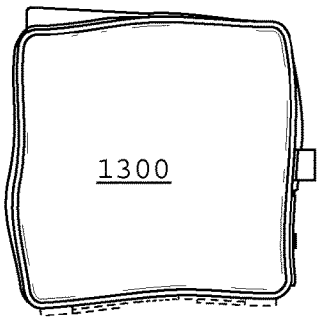
FIG. 3 is a bottom view of the duffle bag of FIG. 1.
Figure 4:
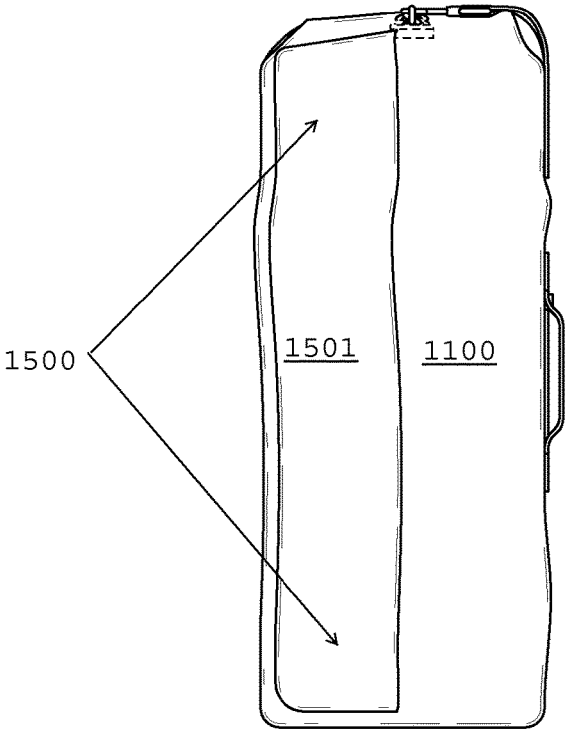
FIG. 4 is a rear view of the duffle bag of FIG. 1.

Referring to FIG. 3, the butt 1300 is defined by a light colored piece of fabric that is in the general shape of a square. Operably, ownership identity information (e.g., name and serial number) may be stenciled on to the butt 1300 to facilitate sorting of multiple bags. The body 1100 may suitably be sewn around the sides of the butt so as to create a closed end tubiform that is transverse to the plane of the butt 1300 and wherein the open end of the tubiform defines the top opening 1200. Referring to FIG. 2, three of the four sides of the top opening 1200 may be provided with an eyelet 1201 while the remaining side is provided with a grommet having a seven inch long chain 1202. Operably, closure of the top opening 1200 is accomplished via threading the chain 1202 through the three remaining eyelets 1201 and either clipping the chain in place with a strap 1203 of the bag or locking the chain 1202 with a lock 1204 that cannot pass back through the eyelets 1201.

Figure 5:
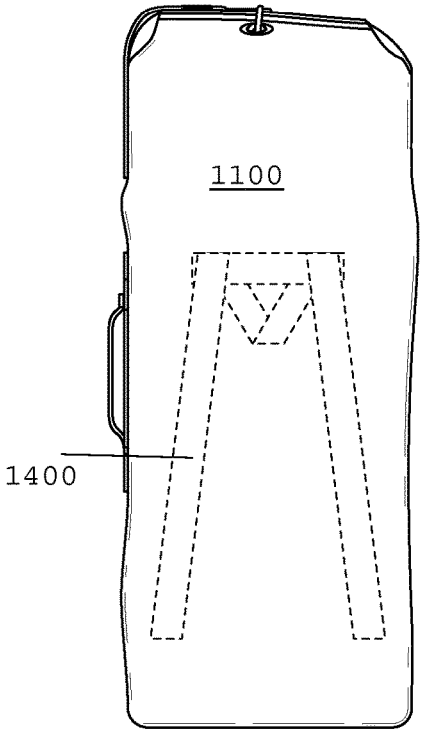
FIG. 5 is a front view of the duffle bag of FIG. 1.
Figure 6:
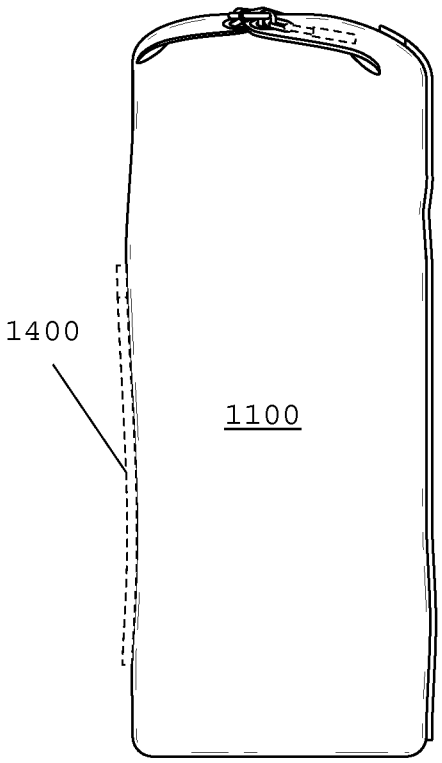
FIG. 6 is a left side view of the duffle bag of FIG. 1.
Figure 7:
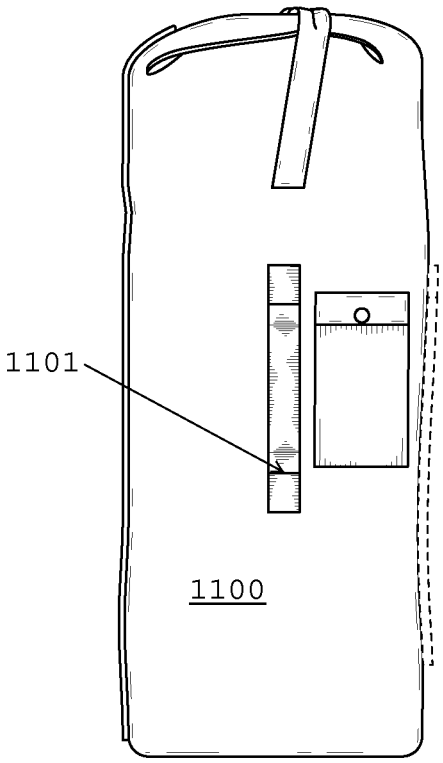
FIG. 7 is a right side view of the duffle bag of FIG. 1.
Figure 8:
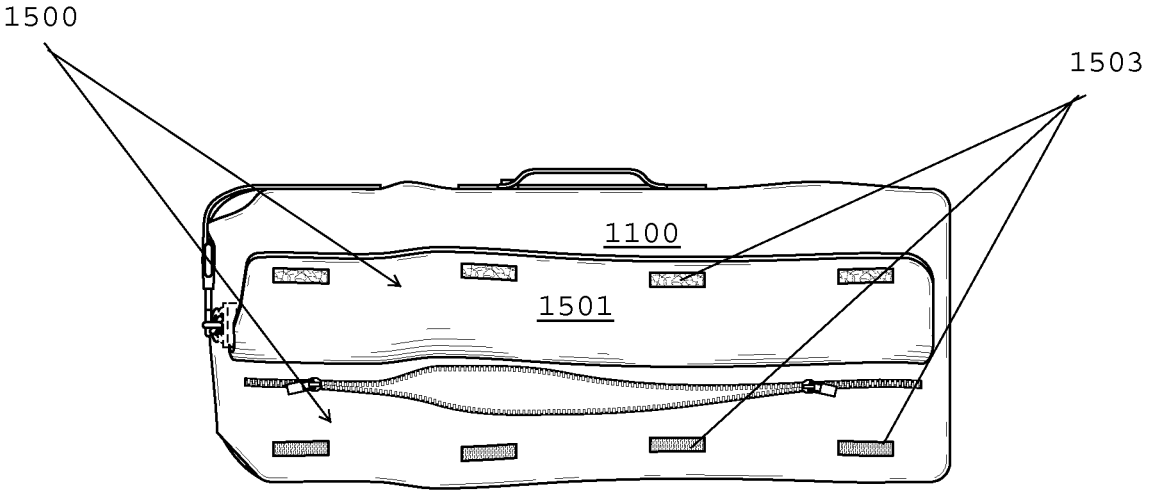
FIG. 8 is an environmental view of the duffle bag of FIG. 1.

The bag may suitably be provided with mechanisms to assist the user in lugging the bag from place to place. Referring first to FIG. 5, one side of the body 1100 may preferably be provided with web straps 1400 so that the bag may be carried in the manner of a back-pack. In one preferred embodiment, the web straps 1400 are two inches in width to assist the user in carrying the bag. In another embodiment, a handle 1101 may be provided centered on one side of the body so that the bag may be toted in the manner of a duffle bag.

As alluded to above, the bag 1000 may suitably feature a side opening 1500 for accessing items retained by the bag. In one preferred embodiment shown in FIG. 8, the side opening 1500 is substantially the length of the bag 1000 and is defined and completely covered by a cover flap 1501 and waterproof zipper 1502. Suitably, the zipper 1502 may be thirty-six inches in length and made of water resistant coils and feature a matte finish. Such zippers can be purchased from Lenzip, which offers a zipper called the Raindefyer #10 that is made with 316 polished stainless steel sliders and pin and box components. Preferably the flap 1501 may be positioned over the zipper 1502 and secured in position via a series of hook and loop fasteners 1503 running along the length of the flap 1501 and zipper 1502.

It should be noted that FIGS. 1 through 8 and the associated description are of illustrative importance only. In other words, the depiction and descriptions of the present invention should not be construed as limiting of the subject matter in this application. Additional modifications may become apparent to one skilled in the art after reading this disclosure.

I claim:

1. A duffle bag for use in a general infantry of a U.S. armed forces, comprising:

a waterproof body configured for retaining items, said body shaped as a rectangular tubiform having a first side, second side, third side and fourth side, an open end and a closed end opposite the open end;

a flap opening at the top end for accessing the items retained by the body;

a square shaped bottom constructed of light-colored fabric that is in the general shape of a square, wherein the body is sewn around the sides of the bottom so as to create the tubiform with the bottom defining the closed end of the tubiform;

a pair of web shoulder straps for carrying the bag by a person, adhered to the tubiform at the first side;

only one handle adhered to and centered on the second side of the tubiform; and a waterproof side opening for accessing the items retained by the body adhered to the third side of the bag, said side opening defined by a cover flap and water proof zipper having a length substantially a length of one of the sides;

wherein the top flap opening is closed and secured via material extending from the first, second, third and fourth sides and folded over the open end and the zipper is made of water resistant coils, and wherein the cover flap has a width approximately half a width of the third side, is positioned over the zipper and secured in position via a series of hook and loop fasteners running along the length of the flap and zipper.

2. The duffle bag of claim 1 wherein the bottom has a dimension of twelve inches and a length of the tubiform is 36 inches.

3. The duffle bag of claim 1, wherein the opening defined by the zipper does not meet the open end.

* * * * *